United States Patent [19]

Shin et al.

[11] Patent Number: 4,764,252

[45] Date of Patent: Aug. 16, 1988

[54] PROCESS FOR PULPING LIGNOCELLULOSIC MATERIAL WITH A PREOXIDIZED ALKALINE SULFIDE PULPING LIQUOR CONTAINING A CYCLIC ORGANIC COMPOUND

[75] Inventors: Yoichi Shin, Yachiyo; Isao Wada, Tokyo; Junichiro Kido, Tokyo; Shigeru Eimaeda, Tokyo, all of Japan

[73] Assignee: Oji Paper Co., Ltd., Tokyo, Japan

[21] Appl. No.: 799,208

[22] Filed: Nov. 19, 1985

Related U.S. Application Data

[63] Continuation of Ser. No. 556,525, Nov. 30, 1983, abandoned, which is a continuation of Ser. No. 132,530, Mar. 21, 1980, abandoned.

[30] Foreign Application Priority Data

Mar. 23, 1979 [JP] Japan ..... 54-33359

[51] Int. Cl.[4] ..... D21C 3/02; D21C 3/20

[52] U.S. Cl. ..... 162/72; 162/65; 162/82; 162/83

[58] Field of Search ..... 162/65, 72, 90, 82, 162/83

[56] References Cited

U.S. PATENT DOCUMENTS 1,855,353 4/1932 Jacobson ..... 423/514
4,363,700 12/1982 Wada et al. ..... 162/72

FOREIGN PATENT DOCUMENTS 49-15248 2/1974 Japan .

*Primary Examiner*—Steve Alvo
*Attorney, Agent, or Firm*—Armstrong, Nikaido, Marmelstein & Kubovcik

[57] ABSTRACT

Lignocellulosic material is pulped by a process comprising the steps of: introducing a molecular oxygen-containing gas, such as air, into an alkaline sulfide solution containing NaOH, $Na_2S$ and at least one cyclic organic compound selected from quinone, hydroquinone, 9,10-diketohydroanthracene and 9,10-dihydroxyhydroanthracene compounds, to oxidize at least a portion of $Na_2S$; delignifying the lignocellulosic material with an alkaline sulfide cooking liquor containing the oxidized alkaline sulfide solution at an elevated temperature and; then, recovering the resultant pulp from the delignification mixture.

12 Claims, 2 Drawing Sheets

PROCESS FOR PULPING LIGNOCELLULOSIC MATERIAL WITH A PREOXIDIZED ALKALINE SULFIDE PULPING LIQUOR CONTAINING A CYCLIC ORGANIC COMPOUND

This application is a continuation of application Ser. No. 556,525 filed Nov. 30, 1983 which is a Rule 60 continuation application of Ser. No. 132,530 filed Mar. 21, 1980, both now abandoned.

FIELD OF THE INVENTION

The present invention relates to a process for pulping lignocellulosic material. More particularly, the present invention relates to a process for pulping lignocellulosic material at a high efficiency by using an alkaline sulfide (kraft or sulfate) pulping liquor.

Still more particularly, the present invention relates to a process for pulping lignocellulosic material by using an alkaline sulfide pulping liquor in which a portion of the sulfide has been oxidized with molecular oxygen.

BACKGROUND OF THE INVENTION

A process for pulping a lignocellulosic material, for example, wood, straw or bagasse, by using an alkaline sulfide cooking liquor containing, as main components, sodium sulfide and sodium hydroxide at an elevated temperature, is referred to as an alkaline sulfide pulping process. This alkaline sulfide pulping process, which includes a kraft process, is a most important chemical pulping process due to its advantage in that the quality of the resultant pulp is higher than that of other pulping processes, for example, a sulfite pulping process. However, on the other hand, the conventional alkaline sulfide pulping process has two disadvantages in that the yield of the resultant pulp is relatively small and the sulfur compound used in the kraft cooking liquor causes an offensive smell. In recent years, these two disadvantages have become an increasing important problem from the standpoints of the manufacturing cost, shortage of wood resources and environmental pollution.

In order to eliminate the above-mentioned disadvantages of the conventional alkaline sulfide pulping process, various approaches were looked into for accelerating the delignification reaction between the lignocellulosic material and the pulping liquor and for preventing the decomposition of the carbohydrates in the lignocellulosic material. Examples of these approaches are: a polysulfide process [Pulping Process Sven A Rydholm, 1965, published by Interscience]; a process comprising adding sodium borohydride (U.S. Pat. No. 3,042,575), hydrazine (U.S. Pat. No. 3,161,562), hydroxylamine (U.S. Pat. No. 3,401,076) or a nitroaromatic compound [Svensk Papperstid 71 (23) 857~863 (1968)]; a process for pre-treating wood chips with hydrogen sulfide (U.S. Pat. No. 3,520,773), and; an alkafide process (U.S. Pat. No. 1,902,106, U.S. Pat. No. 3,347,739). However, all of the above-mentioned approaches, except for a MOXY process belonging to the polysulfide process (Japanese Patent Application Publication (Kokoku) No. 50-40395 which corresponds to U.S. Pat. No. 4,024,229, Norsk Skogindustri June, 1978, pages 134 to 140), have not yet been practically utilzed due to the fact that the approaches cause the pulping apparatus to be expensive or complicated, the cost of the pulping operation to be very high, or the processability of the pulping process to be poor, or result in an environmental pollution or exhibit a poor effect in pulping hardwood. In addition, none of the above-mentioned approaches positively avoid the use of a sulfur compound in the kraft pulping mill nor have any of them eliminated the offensive smell problem in the kraft pulping mill.

Recently, since B. Bach and G. Fiehn, Zellstoff und Papier, vol 21, No. 1, pages 3 to 7 (1972) and related East German Pat. No. 98,549 disclosed that the yield of pulp in the alkaline pulping process could be increased by adding an anthraquinone compound, particularly anthraquinone-2-monosulfonic acid salt (AMS), to the alkaline pulping liquor, various processes in which various anthraquinone compounds were used, have been developed. Examples of these processes are: a two-stage pulping process which comprises a first soda stage and second oxygen-alkali stage or a first kraft stage and second oxygen-alkali stage, and in which sodium anthraquionone-2-sulfonate (AMS) is added to the pulping liquor in the first stage (Japanese Patent Application Laying-open (Kokai) No. 50-29801, U.S. Pat. No. 3,888,727); a pulping process in which the lignocellulosic material is pre-treated with an alkali solution containing AMS (Canadian Pat. No. 986,662), and; a process in which a water-soluble oxygen carrier consisting of a quinone compound or hydroquinone compound is added to an oxygen-alkali pulping liquor (Japanese Patent Application Laying-open (Kokai) No. 51-119801, West German Patent Application Laying-open (Offenlegungsschrift) No. 2,610,891).

Examples of processes comprising adding a quinone compound other than AMS are: a process in which a quinone compound is added to an alkaline cooking liquor (Japanese Patent Application Laying-open (Kokai) No. 51-43403); a process in which a sulphur free cyclic keto compound is added to an alkaline pulping liquor (Japanese Patent Application Laid-Open Publication (Kokai) No. 52-37803, U.S. Pat. No. 4,012,280); a process in which a quinone compound is added to a sulfite pulping liquor (Japanese Patent Application Laid-Open Publication (Kokai) No. 51-112903); a process in which a quinone or hydroquinone compound is added to an alkaline pulping liquor or a sulfite pulping liquor (Japanese Patent Application Laying-open (Kokai) No. 52-155202); a two-stage pulping process which comprises a first soda stage and second oxygen-alkali stage or a first kraft stage and second oxygen-alkali stage, and in which a quinone or hydroquinone compound is added to the pulping liquor in the second stage (Japanese Patent Application Laying-open (Kokai) No. 53-58004); a process in which a cyclic keto compound and a nitro aromatic compound are added to a soda pulping liquor (Japanese Patent Application Laying-open (Kokai) No. 53-74102, West German Patent Application Laying-open (Offengungsschrift) No. 2,755,769); a soda pulping method in which a soda cooking liquor contains both a nitro aromatic compound and a 9, 10-diketohydroanthracene compound selected from unsubstituted and lower alkyl-substituted Diels-Alder adducts of naphthoquinone and benzoquinone (Japanese Patent Application Laying-open (Kokai) No. 53-74103, U.S. Pat. No. 4,036,680); a process in which a 9,10-diketohydroanthracene compound is added to an alkaline pulping liquor (Japanese Patent Application Laying-open (Kokai) No. 53-74104, U.S. Pat. No. 4,036,681); a process in which a 9,10-dioxyhydroanthracene compound is added to an alkaline or sulfite pulping liquor (U.S. Pat. No. 4,181,565, West German Patent Application Laying-open (Offengungsschrift) No. 2,754,991), and; a process in which various quinone compounds are added to an alkaline or sulfite pulping liquor (Japanese Patent Application Laying-open (Kokai) No. 53-139803).

In the above-mentioned prior arts, the quinone or hydroquinone compound alone or a combination of the quinone or hydroquinone compound and oxygen or an oxidizing agent, such as a nitro aromatic compound, were used for accelerating the delignification reaction and increasing the yield of the resultant pulp.

The inventors studied in detail the pulping process using a cooking liquor containing a quinone compound. As a result of this study, it was found that $Na_2S$ and NaHS in the cooking liquor are active as a reducing agent only when the cooking liquor is in a weak alkaline condition or neutral condition, and can reduce the quinone compound into the corresponding hydroquinone compound, while when the cooking liquor is in a strong alkaline condition, $Na_2S$ and NaHS can not exhibit the reducing activity. For this reason, when the addition of the quinone compound is applied to an alkaline sulfide pulping process, an expensive quinone or hydroquinone compound should be added in a large amount. On the basis of this knowledge, the inventors have previously provided a novel alkaline sulfide pulping process which comprises cooking lignocellulosic material with a cooking liquor containing, as main components, sodium sulfide and sodium hydroxide, to which have been added a quinone or hydroquinone compound and at least one reducing assistant selected from the group consisting of sulfites, hydrogensulfites, thiosulfates and formates (Japanese Patent Application Laying-open (Kokai) No. 54-82402). Also the inventors have provided another novel alkaline sulfide pulping process in which a 9,10-diketohydroanthracene compound and/or a 9,10-dihydoxyhydroanthracene compound are added to the pulping liquor, instead of the quinone or hydroquinone compound in the above-mentioned pulping process (Japanese Patent Application Laying-open (Kokai) No. 54-106601).

The inventors further studied in detail the reducing assistant to be added to the redox system in the above-mentioned alkaline sulfide pulping processes. As a result of this study, it was found that, when the reducing assistants produced as a by-product in processes other than a cooking process in a pulping mill are added to the pulping liquor, sulphur circulating through the recovery process is increased in its total amount when the reducing assistants are the oxyacid salt of sulphur, which causes the sulfidity of the cooking liquor to be increased.

The inventors conducted earnest studies to overcome the above-mentioned problem. It is known that a quinone compound which is capable of reversibly converting to a corresponding hydroquinone compound is a catalyst for the conversion of sodium sulfide to sodium thiosulfate by oxydizing an alkaline liquor containing sodium sulfide (U.S. Pat. No. 1,855,353, Japanese Patent Application Laying-open (Kokai) No. 49-15248, Japanese Patent Application Laying-open (Kokai) No. 51-88703). On the basis of this knowledge, the inventors attempted to add a small amount of anthraquinone to a green liquor or white liquor in the kraft recovery process, aerate the liquor under mild conditions at normal temperature and pressure, and analyze the oxidized liquor with the lapse of the aerating time. Surprisingly, it was discovered that, in addition to sodium thiosulfate, a large amount of sodium sulfite is preferentially produced in the course of the air oxidation. In addition, it was also discovered that, when sulphur-containing oxyacid salts, including sodium sulfite, are produced in situ in the cooking liquor, the yield of the resultant pulp becomes higher than that in the case where sodium sulfite is added to the cooking liquor from the outside of the pulping system, and no accumulation of sulphur occurs in the pulping process and in the recovery process.

The present invention was made on the basis of the above-mentioned discoveries.

SUMMARY OF THE INVENTION

An object of the present invention is to provide a process for pulping lignocellulosic material with an alkaline sulfide cooking liquor at a high delignification reaction rate and at a high yield of the resultant pulp having a high quality.

Another object of the present invention is to provide a process for pulping lignocellulosic material which causes the sulfidity of the cooking liquor to be decreased.

Still another object of the present invention is to provide a process for pulping lignocellulosic material which has only a slightly offensive smell.

A further object of the present invention is to provide a process for pulping lignocellulosic material which effectively utilizes various quinone compounds as a delignification-accelerating additive.

The above-mentioned objects can be attained by the process of the present invention which comprises the steps of:

bringing a molecular oxygen-containing gas into contact with an alkaline sulfide solution containing sodium sulfide, sodium hydroxide and at least one cyclic organic compound selected from the group consisting of quinone compounds, hydroquinone compounds, 9,10-diketohydoranthracene compounds and 9,10-dihydroxyhydroanthracene compounds, to oxidize at least a portion of said sodium sulfide;

delignifying, at an elevated temperature, a lignocellulosic material with an alkaline sulfide cooking liquor containing said oxidized alkaline sulfide solution, and;

separating the resultant delignified material from the delignifying mixture.

In the process of the present invention, it is important that the above-specified cyclic organic compound be utilized as a catalyst for oxidizing at least a portion of the sodium sulfide in the alkaline sulfide solution and, thereafter, as a delignification accelerating additive for accelerating the delignification of the lignocellulosic material. Also, it is important that the oxidation product from sodium sulfide be utilized as a reducing assistant for reducing the cyclic organic compound in the delignification operation.

DETAILED DESCRIPTION OF THE INVENTION

As is described above, it is known that when a quinone-hydroquinone compound oxygen-oxidizes an alkaline liquor containing sodium sulfide, it acts as a catalyst for the conversion of sodium sulfide to sodium thiosulfate. On the basis of this knowledge, the following experiment was carried out by the inventors.

Figure 1:
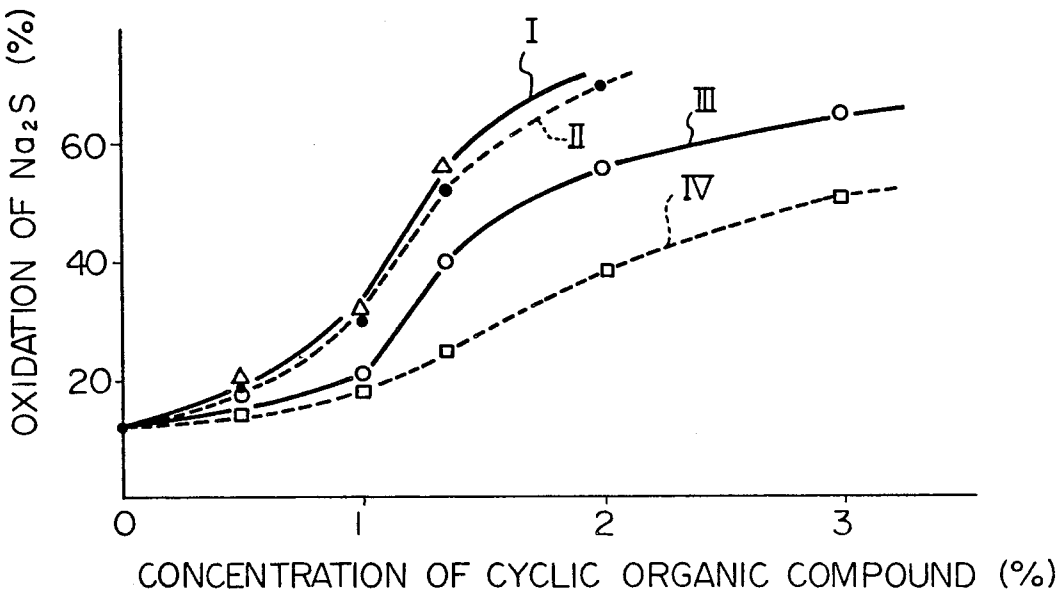
FIG. 1 is a graph illustrating a relationship between amounts of the above specified cyclic organic compounds added to a white alkaline sulfide cooking liquor and the percent of oxidation of sodium sulfide.

A alkaline sulfide solution containing 31.4 g/l of $Na_2S$ (in terms of $Na_2O$) and 94.2 g/l of NaOH (in terms of $Na_2O$), and having a sulfidity of 25% was mixed with AMS, 1,4,4*a*,9*a*-tetrahydro-9,10-diketoanthracene, anthraquinone or anthrone in various amounts. The resulting mixture was placed in a rotary gas-liquid contact reaction vessel having a capacity of 6l. Then, air was passed through the mixture in the reaction vessel at a temperature of 90° C., at a flow rate of 10 l/min., for 60 minutes, thereby to oxidize sodium sulfide. The results are shown in FIG. 1. The amount of the quinones added is expressed in percent based on the weight of $Na_2S$ in terms of $Na_2O$. In FIG. 1, curves I, II, III and IV respectively indicate a percent of oxidation of $Na_2S$ in the presence of AMS, 1,4,4*a*,9*a*-tetrahydro-9,10-diketoanthracene, anthraquinone and anthrone.

It is apparent from FIG. 1 that, when the above-mentioned cyclic organic compounds are added in an amount of from 1 to 3% based on the weight of $Na_2S$, in terms of $Na_2O$, to the alkaline sulfide solution, the oxidation of $Na_2S$ is remarkably promoted. (However, when none of the above-mentioned cyclic organic compounds is added to the alkaline sulfide solution, the percent of oxidation was only 13%.) It is also apparent from FIG. 1 that 1,4,4*a*,9*a*-tetrahydro-9,10-diketoanthracene is an oxidation catalyst as excellent as AMS.

Then, as a oxidation catalyst, 1,4,4*a*,9*a*-tetrahydro-9,10-diketoanthracene was added in an amount of 1.3% based on the weight of $Na_2S$, in terms of $Na_2O$, to the same alkaline sulfide solution as that described above and the resultant white liquor was subjected to oxidation treatment under the same conditions as those described above. As a control, a white alkaline sulfide liquor containing no oxidation catalyst was subjected to the same oxidation treatment as that described above.

Figure 2:
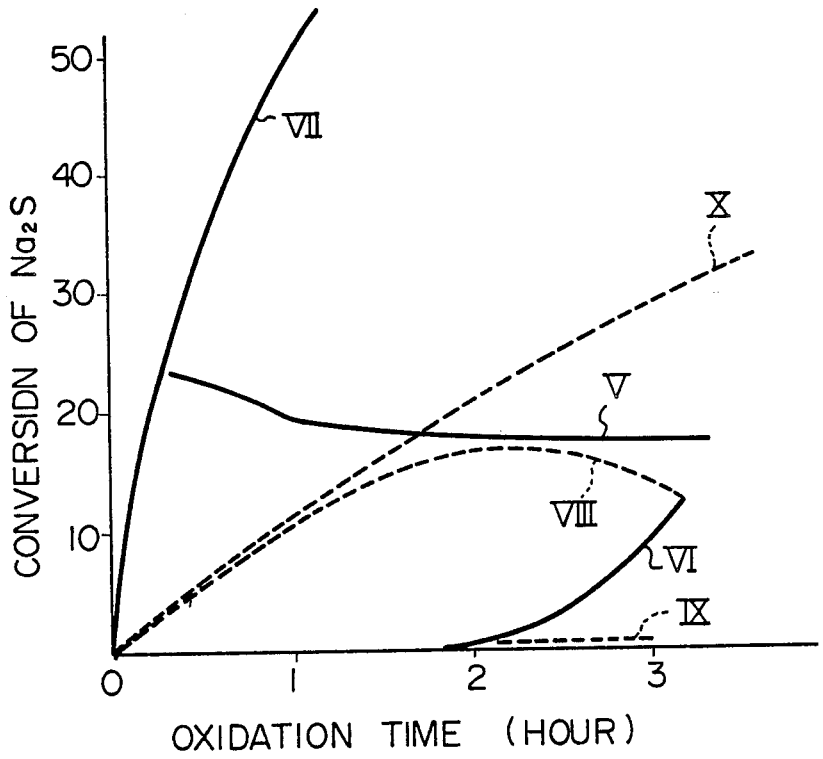
FIG. 2 is a graph illustrating a relationship between period of time of the oxidation of a white alkaline sulfide cooking liquor with air in the presence of 1,4,4*a*,9*a*-tetrahydro-9,10-diketoanthracene and the percent of conversion of $Na_2S$ in comparison with that in the case where no diketoanthracene is used.

In FIG. 2, Curves V, VI and VII respectively indicate a change in the percent of a conversion of $Na_2S$ to $Na_2SO_3$, the percent of a conversion of $Na_2S$ to $Na_2S_2O_3$ and the percents of the entire conversion of $Na_2S$, depending upon the change in oxidation time, in the presence of the oxidation catalyst. Also, Curves VIII, IX and X respectively indicate a change in the percent of a conversion of $Na_2S$ to $Na_2SO_3$, the percent of a conversion of $Na_2S$ to $Na_2S_2O_3$ and the percents of the entire conversion of $Na_2S$, depending upon a change in oxidation time, in the absence of the oxidation catalyst.

FIG. 2 clearly indicates that, in the initial stage of the catalytic oxidation, $Na_2S$ is mainly converted to $Na_2SO_3$.

According, in the case where an alkaline sulfide solution containing sodium sulfide, which has been oxygen-oxidized in the presence of the above-specified cyclic organic compound, is used as an alkaline sulfide cooking liquor, it is not necessary to oxidize all of sodium sulfide in the solution. In this case, it is preferable that sodium sulfide in the alkaline sulfide solution be oxidized in a percent of from 5 to 75%, more preferably from 10 to 50%.

When an alkaline sulfide solution containing sodium sulfide in a concentration of from 0.5 to 15% (amount in gram of $Na_2S$ in terms of $Na_2O$ per gram of bone dry lignocellulosic material), is subjected to the above-mentioned oxidation treatment in a percent of oxidation of from 5 to 75%, the above-mentioned concentration of sodium sulfide is changed to that in the range of from about 0.2 to about 12%, preferably, from about 0.5 to about 9%, whereby the resulting oxidized solution has a low sulfidity. Since the oxidized solution having a low sulfidity contains a proper amount of sodium sulfite and the cyclic organic compound which is effective as a delignification accelerating additive, the oxidized solution is useful as an alkaline sulfide cooking liquor for producing pulp in a high degree of yield.

When the alkaline sulfide solution is oxygen-oxidized in the presence of the above-specified cyclic organic compound, $Na_2SO_3O$ and $Na_2S_2O_3$, which are sulphur-containing oxyacid salts, are produced as main oxidation products. However, when the degree of oxidation of $Na_2S$ is excessively increased, the oxidation product contains $Na_2SO_4$. Also, in view of the results of the air oxidation of the white alkaline sulfide solution in the presence of phenols as a catalyst [paperi ja Puu NO2, 43 (1959)] and the air oxidation of the alkaline sulfide solution mixed with a black cooking liquor [Tappi vol 48, NO. 5, 56A (1965), U.S. Pat. No. 3,216,887], it is estimated that in the oxidation of $Na_2S$, a small amount of polythionates having an excellent reducing activity or polysulfides having a stabilization effect for carbohydrates of cellulose is produced. In addition, it is estimated that the $Na_2SO_3$ and $Na_2S_2O_3$, which have been produced in situ in the alkaline sulfide solution by the oxygen-oxidation in accordance with the present invention, exhibit a higher reactivity than those produced outside the process of the present invention.

The alkaline sulfide solution containing sodium sulfide usable for the present invention may be a white cooking liquor containing sodium sulfide and sodium hydroxide as main components or a green cooking liquor containing sodium sulfide and sodium carbonate as main components.

The cyclic organic compound usable for the present invention is selected from the group consisting of quinone compounds, hydroquinone compounds, 9,10-diketohydroanthracene compounds and 9,10-dihydroxyhydroanthracene compounds.

The quinone compound may be selected from the group consisting of benzoquinone, naphthoquinone, anthraquinone, anthrone, phenanthrenequinone, and the alkyl, alkoxy, hydroxy, amino, halogen, carboxy, sulfonic acid and carboxylic acid derivatives of the above-mentioned quinone compounds. A hydroquinone compound which is a reduced form of the above-mentioned quinone compounds may also be used for the present invention. Examples of the hydroquinone compound are hydroquinone, naphthohydroquinone, anthrahydroquinone, alkylanthrahydroquinone, alkoxyanthrahydroquinone, aminoanthrahydroquinone, haloanthrahydroquinone, hydroxyanthrahydroquinone, carboxyanthrhydroquinone and the tautomers of the above-mentioned anthrahydroquinones compounds. Examples of the above-mentioned tautomers are 10-hydroxy-anthrone, 1- and 2-alkyl-10-hydroxy-anthrone, 1- and 2-amino-10-hydroxy-anthrone, 1- and 2-hydroxy-10-hydroxy-anthrone, and 1- and 2-halo-10-hydroxy-anthrone.

As the cyclic organic compound, use may be made of at least one compound selected from the group consisting of 9,10-diketohydroanthracene compounds and 9,10-dihydroxyhydro-anthracene compounds which are stable compounds obtained as an intermediate product in a process for synthesizing anthraquinone by a Diels-Alder reaction.

The 9,10-diketohydroanthracene compound usable for the present invention can be selected from the group consisting of 1,4-dihydro-9,10-diketoanthracene, 1,2,3,4-tetrahydro-9,10-diketoanthracene, 1,4,4*a*,9*a*-tetrahydro-9,10-diketoanthracene, 2-ethyl-1,4,4*a*,9*a*-tetrahydro-9,10-diketoanthracene, 2,3-dimethyl-1,4,4*a*,9*a*-tetrahydro-9,10-diketoanthracene, 1,3-dimethyl-1,4,4*a*,-9*a*-tetrahydro-9,10-diketoanthracene, 1-methyl-1,2,3,4-tetrahydro-9,10-diketoanthracene, 1,2,3,4,5,8-hexahydro-9,10-diketoanthracene, 1,4,4*a*,5,8,8*a*,9*a*,10*a*-octahydro-9,10-diketoanthracene, 2,3,6,7-tetramethyl-1,4,4*a*,5,8,8*a*,9*a*,10*a*-octahydro-9,10-diketoanthracene, 1,2,3,4,5,6,7,8-octahydro9,10-diketoanthracene, 2,6-diethyl-1,4,4*a*,5,8,8*a*,9*a*,10*a*-octahydro-9,10-diketoanthracene, and 2,7-diethyl-1,4,4*a*,5,8,8*a*,9*a*,10*a*-octahydro-9,10-diketoanthracene. The preferable 9,10-diketohydroanthracene compound may be selected from the unsubstituted and lower alkyl substituted Diels-Alder adducts of naphthoquinone and benzoquinone. From the point of view of activity and economy, the most preferable 9,10-diketohydroxyanthracene compound is 1,4-dihydro-9,10-diketoanthracene 1,4,4*a*,-9*a*-tetrahydro-9,10-diketoanthracene and 1,4,4*a*,5,8,8*a*,-9*a*,10*a*-octahydro-9,10-diketoanthracene.

The 9,10-dihydroxyhydroanthracene compound usable for the present invention may be selected from the group consisting of 1,4-dihydro-9,10-dihydroxyanthracene, 1,4,5,8-tetrahydro-9,10-dihydroxyanthracene, 1,4,5,8,8*a*,10*a*-hexahydro-9,10-dihydroxyanthracene and sodium and potassium salts of 1,4-dihydro-9,10-dihydroxyanthracene.

The amount of the above-specified cyclic organic compound to be added to white liquor or green liquor, which constitutes an alkaline sulfide solution containing sodium sulfide, is in the range of from 0.1 to 50% by weight, preferably from 0.5 to 10% by weight, based on the weight of $Na_2S$ in terms of $Na_2O$. The oxygen-oxidation is usually carried out by introducing a molecular oxygen-containing gas, such as air, a mixture of air with oxygen gas, oxygen gas or other oxygen-containing gas, into the above-mentioned alkaline sulfide solution. The oxidation operation is carried out at a temperature of from 20° to 200° C., preferably, from 50° to 100° C. under atmospheric pressure or super atmospheric pressure, preferably, at a pressure of 10 atmospheres or less.

In the case where the alkaline sulfide solution, which has been oxidized by the molecular oxygen-containing gas, is used as a cooking liquor, it is preferable that from 5 to 75%, more preferably, from 10 to 50%, of the $Na_2S$ contained in the alkaline sulfide solution be oxidized. When the alkaline sulfide solution to be oxidized is a green liquor, the green liquor is causticized with calcium hydroxide to convert it to a white liquor, before using it as a cooking liquor. Accordingly, in this case, the cyclic organic compound must be water-soluble. An oxidized white alkaline sulfide solution may be mixed with an additional amount of a non-oxidized white alkaline sulfide solution to prepare a cooking liquor. In this case, it is possible to adjust the concentration of the cyclic organic compound in the cooking liquor. Also, in this case, the oxidized portion of the sodium sulfide in the oxidized sulfite solution may be in an amount corresponding to 75% or more of the original amount of $Na_2S$ contained in the sulfide solution.

The sulfidity of the alkaline sulfide solution before the oxygen-oxidation treatment is preferably in the range of from 5 to 50%. It is preperable that the sulfidity of the cooking liquor after the oxidation be in a range of from 2 to 40%, preferably, from 5 to 30%. Also, it is preferable that the cooking liquor contain from 5 to 30% of an active alkali. The cooking operation is preferably carried out at a temperature of from 140° to 190° C., more preferably, from 140° to 180° C.

In the process of the present invention, when the delignifying operation is completed, the resultant delignified material is separated from the delignifying mixture (spent liquor) by means of filtration. After that the delignified material is washed with water or an aqueous liquid inert to the lignocellulosic material, for example, the spent liquor from the later stage of an alkaline bleaching process or the "white water" from the later stage of a paper making process.

In the pulping process of the present invention, various lignocellulosic materials, including hardwood chips, softwood chips and saw dust, and non-wood plant type cellulosic materials, such as bagasse, bast fibers, straw, reeds and other annual plants may be used.

The present invention will be illustrated by the examples set forth below, which are not intended to limit the scope of the present invention. In the examples, the oxygen-oxidation of an alkaline sulfide solution containing sodium sulfide, the cooking of a lignocellulosic material, the bleaching test of the resulting pulp and the determination of the physical properties of the resulting pulp were carried out using the following procedures, unless stated otherwise.

Oxygen-oxidation of an alkaline sulfide solution containing sodium sulfide

In a rotating gas-liquid contact reaction vessel having a capacity of 6 liters, a cyclic organic compound was mixed with a white alkaline sulfide solution having a sulfidity of 25% at a predetermined proportion in weight of the cyclic organic compound to $Na_2S$, in terms of $Na_2O$, in the white alkaline sulfide solution. Then, air was passed through the mixture in the vessel, at a temperature of 90° C., at a flow rate of 10 l/min., for 60 minutes, to oxidize at least a portion of $Na_2S$ in the white alkaline sulfide solution.

Cooking of lignocellulosic material

In the case of hardwood (beech chips), 1700 g in air dry weight of beech chips were placed in an 8 liter autoclave made of stainless steel and mixed with a kraft cooking liquor consisting of the oxidized alkaline sulfide solution diluted with water, in a ratio of the bone dry weight of the chips to the weight of the cooking liquor of 1:4. The cooking liquor contained a predetermined effective amount of alkali. The cooking operation was carried out by heating the cooking mixture in the autoclave to a maximum temperature of 165° C. over 85 minutes and maintaining it at this temperature for 80 minutes.

In the case of softwood (Douglas-fir chips), 1500 g in air dry weight of Douglas-fir chips were placed in an 8 liter autoclave made of stainless steel and mixed with a kraft cooking liquor consisting of the oxidized alkaline sulfide solution diluted with water, in a ratio of the bone dry weight of the chips to the weight of the cooking liquor of 1:4.5. The cooking liquor contained a predetermined effective amount of alkali. The cooking operation was carried out by heating the cooking mixture to a maximum temperature of 170° C. over 90 minutes and maintaining it at this temperature for from 90 to 120 minutes.

After the cooking operation was complete, the pulping mixture was disintegrated by a disintegrator, dewatered by a centrifugel separator, washed with water and screened through a flat screen to remove rejects from the resulting pulp.

Bleaching test

This test was carried out by subjecting the resulting pulp, which had been separated from the rejects, to a conventional bleaching process, in which the pulp was bleached in a conventional sequence comprising chlorination, alkali extraction, hypochlorite treatment and chlorine dioxide treatment (C-E-H-D).

Determination of physical property of pulp

The resulting pulp (unbleached) was beaten in a PFI mill to such an extent that the resultant pulp exhibited a Canadian Standard Freeness of 500 ml, and the beaten pulp was hand-fabricated into a sheet having a weight of 60 g/m$^2$ in accordance with T205 OS-71(JIS P8209) of TAPPI method. The sheet was subjected to the following test procedures.

Examples 1 through 3 and Comparison Examples 1 through 2

In each of Examples 1 through 3 and Comparison Examples 1 through 2, beech chips were cooked.

In each of the Examples 1 and 2, an alkaline sulfide solution containing 94.2 g/l of NaOH and 31.4 g/l of $Na_2S$ in terms of $Na_2O$, and 9, 10-anthraquinone or 1, 4, 4*a*, 9*a*-tetrahydro-9, 10-diketoanthracene, in an amount indicated in, Table 1 was oxidized with air under conditions as indicated in Table 1. The oxidation products are indicated in Table 1. The resultant oxidized alkaline sulfide solution was used as a cooking liquor.

In Example 3, the same oxidized alkaline sulfide solution as that described above was mixed with the same non-oxidized alkaline sulfide solution as that described above in a ratio of 1:1, to prepare a cooking liquor.

In each of Comparison Examples 1 and 2, the same non-oxidized alkaline sulfide solution as that mentioned above was used as a cooking liquor, except that the sulfidity thereof was adjusted to a similar Kappa number to that of Examples 1, 2 and 3.

In each of Examples 1 through 3 and Comparison Examples 1 and 2, the beech chips were cooked with the cooking liquor under the conditions indicated in Table 1.

The results of the cooking operation are indicated in Table 1.

TABLE 1

| Item | | | Example No. | | | | |
|---|---|---|---|---|---|---|---|
| | | | Comparison Example 1 | Example 1 | Comparison Example 2 | Example 2 | Example 3 |
| Oxidation condition | Cyclic organic Compound | Type | — | 9,10-anthraquinone | — | 1,4,4a,9a-tetrahydro-9,10-diketo-anthracene | 1,4,4a,9a-tetrahydro-9,10-diketo-anthracene |
| | | Concentration (%) | — | 1.34 | — | 1.34 | 1.34 |
| | Temperature (°C.) | | — | 80 | — | 90 | 90 |
| | Time (min.) | | — | 120 | — | 120 | 120 |
| | Flow rate of air (l/min.) | | — | 10 | — | 10 | 10 |
| Result of Oxidation | Percent of Oxidation | | — | 40.7 | — | 67.4 | 67.4 |
| | Amount of compounds in oxidation product (g/l) | $Na_2S$ | — | 17.13 | — | 9.42 | 9.42 |
| | | $N_2SO_3$ | — | 5.78 | — | 4.31 | 4.31 |
| | | $Na_2S_2O_3$ | — | 1.73 | — | 3.50 | 3.50 |
| | | $Na_2SO_4$ | — | 1.28 | — | 4.67 | 4.67 |
| | | Others | — | 2.98 | — | 7.00 | 7.00 |
| Cooking Condition | Content of effective alkali (%) | | 13 | 13 | 14 | 14 | 13 |
| | Sulfidity (%) | | 23 | 16.5 | 15 | 9.8 | 18.1 |
| | Temperature (°C.) | | 165 | 165 | 165 | 165 | 165 |
| | Time (min.) | | 80 | 80 | 80 | 80 | 80 |
| Pulp | Yield of pulp (%) | | 52.2 | 54.2 | 51.1 | 53.4 | 53.0 |
| | Kappa number | | 21.0 | 21.2 | 20.0 | 19.6 | 20.0 |
| | Unbleached brightness (%) | | 25.0 | 24.6 | 27.2 | 28.0 | 26.3 |
| | Bleached brightness (%) | | 81.4 | 81.0 | 82.1 | 82.4 | 82.2 |
| | Yield rate of bleaching (%) | | 94.8 | 94.6 | 95.3 | 95.5 | 95.1 |
| | Yield of bleached pulp (%) | | 49.5 | 51.3 | 48.7 | 51.0 | 50.4 |
| Mechanical properties of Unbleached pulp | Burst factor | | 4.3 | 4.5 | 4.1 | 4.3 | 4.3 |
| | Breaking length (km) | | 5.7 | 6.0 | 5.4 | 5.8 | 6.0 |
| | Tear factor | | 94 | 92 | 92 | 92 | 94 |

Kappa number: TAPPI method T 236 m-60
Brightness: JIS P8123

The breaking length, burst factor, and tear factor of the resulting pulp were measured in accordance with a testing method for the strength of paper-making pulp (JIS P8210) respectively using the apparatuses described in JIS P8113, JIS P8112 and JIS P8116.

Examples 4 and 5 and Comparison Examples 3 and 4

In each of Examples 4 and 5 and Comparison Examples 3 and 4, Douglas-fir chips were cooked.

In Examples 4 and 5, the cooking of Douglas-fir chips was carried out using the same procedures as those described in Examples 1 through 3, except that anthrone was used as the cyclic organic compound in Example 4 and AMS was used as the cyclic organic compound in Example 5.

In each of comparison Examples 3 and 4, the same procedures as those as described in Example 4 or 5 were carried out, except that the same non-oxidized alkaline sulfide solution as that described in Examples 4 and 5 was used as a cooking liquor, and except that the sulfidity thereof was adjusted to a value similar to that of Examples 4 and 5. The oxidation conditions and the results of the oxidation in Examples 4 and 5, and the cooking conditions and the results of the cooking in Examples 4 and 5, and Comparison Examples 3 and 4 are shown in Table 2.

TABLE 2

| Item | | | Example No. Comparison Example 3 | Example 4 | Comparison Example 4 | Example 5 |
|---|---|---|---|---|---|---|
| Oxidation condition | Cyclic organic compound | Type | — | Anthrone | — | AMS |
| | | concentration (%) | — | 1.03 | — | 1.03 |
| | Temperature (°C.) | | — | 70 | — | 70 |
| | Time (min.) | | — | 120 | — | 120 |
| | Flow rate of air (l/min.) | | — | 10 | — | 10 |
| Results of oxidation | Percent of oxidation | | — | 25.9 | — | 46.2 |
| | Amount of compounds in oxidation products | $Na_2S$ | — | 21.40 | — | 15.54 |
| | | $Na_2SO_3$ | — | 3.75 | — | 3.18 |
| | | $Na_2S_2O_3$ | — | 1.16 | — | 2.89 |
| | | $Na_2SO_4$ | — | 1.81 | — | 2.92 |
| | | others | — | 0.78 | — | 4.37 |
| Cooking condition | content of effective alkali (%) | | 17 | 17 | 17 | 17 |
| | Sulfidity (%) | | 20 | 19.8 | 15 | 15.2 |
| | Temperature (°C.) | | 170 | 170 | 170 | 170 |
| | Time (min.) | | 90 | 90 | 120 | 120 |
| Pulp | Yield of pulp (%) | | 47.1 | 48.6 | 47.2 | 48.2 |
| | Kappa number | | 40.3 | 36.7 | 42.5 | 34.8 |
| | Unbleached brightness (%) | | 21.6 | 22.8 | 20.5 | 23.3 |
| Mechanical structures of unbleached pulp | Burst factor | | 6.5 | 6.7 | 6.6 | 6.4 |
| | Breaking length (km) | | 7.8 | 7.8 | 7.4 | 7.6 |
| | Tear factor | | 254 | 270 | 238 | 265 |

It is apparent from Tables 1 and 2 that when lignocellulosic material including hardwood and softwood is cooked with the cooking liquor containing the oxidized alkaline sulfide solution in the presence of the specified cyclic organic compounds, the sulfidity of the cooking liquor can be remarkably reduced and, at the same time, it is possible to increase substantially the yield of the resulting pulp without deteriorating the bleaching property and strength thereof.

Because it is possible to use a cooking liquor having a low sulfidity for cooking lignocellulosic material, environmental pollution and development of an offensive smell are reduced. In addition, the process of the present invention has the advantage that the specified cyclic organic compound is used in both the oxidation of $Na_2S$ in the alkaline sulfide solution and the cooking of lignocellulosic material.

We claim:

1. A process for pulping lignocellulosic material comprising the steps of:

(A) bringing a molecular oxygen-containing gas into contact, at a temperature of from 20° to 200° C., with an alkaline sulfide solution containing (a) sodium sulfide in an amount corresponding to a sulfidity of from 5 to 50%, (b) sodium hydroxide and (c) at least one cyclic organic compound selected from the group consisting of quinone compounds, hydroquinone compounds, 9,10-diketohydroanthracene compounds and 9,10-dihydroxyhydroanthracene compounds and being in an amount of from 0.1 to 50% based on the weight of sodium sulfide in said alkaline sulfide solution, to an extent that at least 5% by weight of the original amount of said sodium sulfide are oxidized into $Na_2SO_3$ in a major amount and $Na_2S_2O_3$ in a minor amount;

(B) preparing an alkaline sulfide delignifying liquor from a solution selected from at least one of the following, the oxidized alkaline sulfide solution and the oxidized solution mixed with an additional amount of a non-oxidized white alkaline sulfide solution, while controlling the composition of the resultant alkaline sulfide delignifying liquor to have an effective alkali content of from 5% to 30% and a sulfidity of from 2% to 40%;

(C) delignifying at a temperature of from 140° to 190° C., a lignocellulosic material with the alkaline sulfide delignifying liquor to produce a pulp; and (D) separating the resultant delignified material from the delignifying mixture.

2. A process as claimed in claim 1, wherein said alkaline sulfide delignifying liquor consists of said oxidized sulfide solution.

3. A process as claimed in claim 2, wherein said oxidized amount of sodium sulfide in said oxidized alkaline sulfite solution corresponds to from 5 to 75% by weight of the original amount of said sodium sulfide in said alkaline sulfide solution.

4. A process as claimed in claim 1, wherein said alkaline sulfide delignifying liquor consists of a mixture of said oxidized alkaline sulfide solution and an additional amount of a non-oxidized alkaline sulfide solution.

5. A process as claimed in claim 4, wherein said oxidized amount of sodium sulfide in said oxidized alkaline sulfide solution corresponds to 75% or more of the original amount of sodium sulfide in said alkaline sulfide solution.

6. A process as claimed in claim 1, wherein said molecular oxygen-containing gas is air.

7. A process as claimed in claim 1, wherein said quinone compound is selected from the group consisting of benzoquinone, naphthoquinone, anthraquinone, anthrone, phenanthrenequinone and the alkyl, alkoxy, hydroxy, amino, halogen, carboxy, sulfonic acid and carboxylic acid derivatives of the above-mentioned quinone compounds.

8. A process as claimed in claim 1, wherein said hydroquinone compound is selected from the group consisting of hydroquinone, naphthohydroquinone, anthrahydroquinone, alkylanthrahydroquinone, alkoxyanthrahydroquinone, aminoanthrahydroquinone, haloanthrahydroquinone, hydroxyanthrahydroquinone, carboxyanthrahydroquinone and the tautomers of the above-mentioned anthrahydroquinone compounds.

9. A process as claimed in claim 1, wherein said 9,10-diketohydroanthracene compound is selected from the group consisting of 1,4-dihydro-9,10-diketoanthracene, 1,2,3,4-tetrahydro-9,10-diketoanthracene, 1,4,4*a*,9*a*-tetrahydro-9,10-diketoanthracene, 2-ethyl-1,4,4*a*,9*a*-tetrahydro-9,10-diketoanthracene, 2,3-dimethyl-1,4,4*a*,9*a*-tetrahydro-9,10-diketoanthracene, 1,3-dimethyl-1,4,4*a*,9*a*-tetrahydro-9,10-diketoanthracene, 1-methyl-1,2,3,4-tetrahydro-9,10-diketoanthracene, 1,2,3,4,5,8-hexahydro-9,10-diketoanthracene, 1,4,4*a*,5,8,8*a*,9*a*,10*a*-octahydro-9,10-diketoanthracene, 2,3,6,7-tetramethyl-1,4,4*a*,5,8,8*a*,9*a*,10*a*-octahydro-9,10-diketoanthracene, 1,2,3,4,5,6,7,8-octahydro-9,10-diketoanthracene, 2,6-diethyl-1,4,4*a*,5,8,8*a*,9*a*,10*a*-octahydro-9,10-diketoanthracene, and 2,7-diethyl-1,4,4*a*,5,8,8*a*,9*a*,10*a*-octahydro-9,10-diketoanthracene, and unsubstituted and lower alkyl substituted Diels-Alder adducts of naphthoquinone and benzoquinone.

10. A process as claimed in claim 1, wherein said 9,10-dihydroxyhydroanthracene compound is selected from the group consisting of 1,4-dihydro-9,10-dihydroxyanthracene, 1,4,5,8-tetrahydro-9,10-dihydroxyanthracene, 4,5,8,8*a*,10*a*-hexahydro-9,10-dihydroxyanthracene, and sodium and potassium salts of 1,4-dihydro-9,10-dihydroxyanthracene.

11. A process as claimed in claim 1, wherein the sulfidity of the alkaline sulfide solution is decreased.

12. A process as claimed in claim 1, wherein the alkaline cooking liquor is recovered and there is no accumulation of sulfur in recovery of the alkaline sulfide delignifying liquor.

* * * * *